US006790383B2

(12) United States Patent
Kim

(10) Patent No.: US 6,790,383 B2
(45) Date of Patent: Sep. 14, 2004

(54) METHOD OF GASIFYING CARBONACEOUS MATERIALS

(76) Inventor: Hyun Yong Kim, 449-6, Pyeongchang-dong, Jongro-ku (KR)

( * ) Notice: Subject to any disclaimer, the term of this patent is extended or adjusted under 35 U.S.C. 154(b) by 147 days.

(21) Appl. No.: 09/788,222

(22) Filed: Feb. 16, 2001

(65) Prior Publication Data

US 2002/0113228 A1 Aug. 22, 2002

(30) Foreign Application Priority Data

Dec. 11, 2000 (KR) ..... 2000-75112

(51) Int. Cl.[7] ..... C01B 3/02; C01B 3/32; C01B 3/34; C01B 3/36

(52) U.S. Cl. ..... 252/373; 48/197 FM; 48/197 R; 48/200; 48/201; 48/202; 48/209; 48/210; 48/211; 48/214 R

(58) Field of Search ..... 252/373; 48/197 R, 48/200, 201, 202, 209, 210, 211, 214 R, 197 FM

(56) References Cited

U.S. PATENT DOCUMENTS 3,759,677 A * 9/1973 White ..... 252/373
3,823,227 A * 7/1974 White ..... 252/373
5,145,491 A * 9/1992 Schmitt et al. ..... 48/197 R
5,656,044 A * 8/1997 Bishop et al. ..... 48/197 R
5,980,858 A * 11/1999 Fujimura et al. ..... 252/373
6,063,355 A * 5/2000 Fujimura et al. ..... 252/373

* cited by examiner

*Primary Examiner*—Wayne A. Langel
(74) *Attorney, Agent, or Firm*—Perkins Coie LLP

(57) ABSTRACT

A method of gasifying organic materials (carbonaceous compounds) such as coal, shredded waste tire or waste oil into gaseous fuel, carbon monoxide and hydrogen, and an apparatus therefore are provided. The method comprises the steps of supplying initial fuel gas and oxygen into a gasification reactor to produce water and carbon dioxide, supplying the organic materials into the reactor and reacting them with the water and carbon dioxide to produce carbon monoxide and hydrogen gas, discharging the carbon monoxide and hydrogen gas from the reactor, recycling a part of the carbon monoxide and hydrogen gas discharged from the reactor into the reactor, and reacting the carbon monoxide and hydrogen gas supplied into the reactor with oxygen to produce water and carbon dioxide. The method facilitates the control of temperature in the gasification reactor as well as produces fuel gas of high quality by increasing the concentration of hydrogen.

1 Claim, 9 Drawing Sheets

• FEEDING POINT

Ⓣ THERMOCOUPLES POINT

METHOD OF GASIFYING CARBONACEOUS MATERIALS

BACKGROUND OF THE INVENTION

1. Field of the Invention

The present invention relates to a method of gasifying organic materials (carbonaceous compounds) such as coal, waste oil or shredded waste tire into gaseous fuel, carbon monoxide and hydrogen, and an apparatus therefor.

2. Description of the Related Art

Gasification of liquid wastes such as waste oil or waste organic solvent and solid organic materials such as coal or shredded waste tire means converting carbon and hydrogen contained in the organic materials into fuel gases, carbon monoxide and hydrogen gas (generally called syngas). Since gasification is endothermic reaction requiring continuous supply of heat, the gasification furnace should be kept at a high temperature sufficient to continue the reaction.

In the conventional method of gasification, the gasification furnace is kept at a high temperature by means of combustion heat generated from the oxidation reaction of organic materials supplied for gasification with oxygen. Further, in the state of high temperature sufficient to gasification reaction, steam or water is supplied to promote gasification and increase the concentration of hydrogen in the produced syngas.

FIGS. 1*a* to 1*c* illustrate schematically the mechanism of conventional system applied to gasification reactor for coal; FIGS. 1*a*, 1*b* and 1*c* indicate static floor type, fluid floor type, and flush fluid floor type, respectively. Coal, a sort of organic material, is typically gasified by one of the three conventional methods according to its size. Each method differs in supplying coal, oxygen and steam, and in discharging gases produced from gasification reaction and remained ash, while the reaction carried out in the gasification reactor is identical with each other. Generally, static floor type is applied to natural coal lumps, fluid floor type is to coal of several millimeter sizes, and flush fluid floor type is to coal of scores of micrometer sizes.

U.S. Pat. No. 6,120,567 (Sep. 19, 2000) describes a heating system for producing heat by the gasification of solid, organic biomass materials. In the method, the organic materials in a primary oxidation chamber of the catalytic type are gradually heated in a deficiency of oxidation to produce a gaseous combustible effluent, which is further oxidized to a fully oxidized state by burning in a secondary oxidation chamber.

U.S. Pat. No. 6,084,147 (Jul. 4, 2000) discloses a method for decomposing waste material contaminated with metal ions, wherein decomposition takes place quickly by injecting a steam/oxygen mixture into a fluidized bed of ceramic beads. In this method, the fluidizing gas mixture agitates the beads that then help to break up solid wastes, and the oxygen allows some oxidation to offset the thermal requirements of drying, pyrolysis, and steam reforming. Most of the pyrolysis takes place in the first stage, setting up the second stage for completion of pyrolysis and adjustment or gasification of the waste form using co-reactants to change the oxidation state of inorganics and using temperature to partition metallic wastes.

Further, U.S. Pat. No. 6,001,144 (Dec. 14, 1999) describes a process of gasifying waste containing organic substances which may be combusted or gasified by means of partial oxidation in the presence of air or oxygen and steam.

The gasification process includes the step of adjusting the molar ratio of steam/carbon ($H_2O/C$) for supplied steam and the organic substances containing carbon to be substantially between 1 and 10, partially oxidizing the organic substances at a temperature substantially between 700 and 900° C., and discontinuing the supply of steam while continuing to supply air or oxygen to combust the remaining combustibles having carbon as their major component.

Since gasification is endothermic reaction, the reactor is required to be kept at a high temperature about 1,300° C. for continuing the reaction. In conventional gasification methods, oxygen is supplied with organic materials ($—CH_2$) to the gasification reactor, thereby inducing oxidation of carbon and hydrogen components in the organic materials and producing combustion heat from the oxidation to maintain such high temperature required to the gasification in the reactor. The oxidation reaction is indicated as follows:

$$C+O_2 \rightarrow CO_2 \quad (1)$$

$$2(—CH_2)+3O_2 \rightarrow 2H_2O+2CO_2 \quad (2)$$

Reaction 1 indicates the combustion reaction usually occurred in coal whose main component is carbon, and Reaction 2 is the main combustion reaction occurred in organic materials such as waste oil.

The requirement of oxygen, which varies with the aspect of coal (C) or waste oil ($—CH_2$) supplied into the reactor, amounts to 0.5~1.0 weight of the coal or waste oil. The oxygen supplied into the reactor is consumed according to the Reaction 1 and 2 to increase the temperature in the reactor and produce combustion products, $H_2O$ and $CO_2$.

The combustion products undergo gasification reaction with carbon, which is main component of the organic materials, as indicated in Reactions 3 and 4. The gasification reaction requires longer reaction time as compared with combustion reaction and higher temperature to continue the reaction. The gasification reactions of organic materials such as waste oil ($—CH_2$) are indicated as Reactions 5 and 6.

$$C+H_2O \rightarrow CO+H_2 \quad (3)$$

$$C+CO_2 \rightarrow 2CO \quad (4)$$

$$(—CH_2)+H_2O \rightarrow CO+2H_2 \quad (5)$$

$$(—CH_2)+CP_2 \rightarrow 2CO+H_2 \quad (6)$$

While the Reactions 1 and 2 are oxidation reaction, the Reactions 3 to 6 are reduction reaction. The gas produced from the reactions is fuel gas whose main components are CO and $H_2$.

In conventional gasification methods, gasification reaction (Reactions 3 to 6) uses oxidation reaction (Reactions 1 and 2) which is induced by oxygen supplied with coal or waste oil for increasing the temperature of the gasification reactor. Further, additional supply of steam of high temperature is required to increase the concentration of hydrogen through water gas shift reaction (Reaction 7). The steam is acquired by means of heat exchange with fuel gas of high temperature in the boiler installed for cooling the fuel gas in the gasification reactor.

$$CO+H2O \rightarrow H2+CO2 \quad (7)$$

As described in the above, in conventional gasification methods, oxidation reaction (Reactions 1 and 2), reduction reaction (Reactions 3 to 6) and water gas shift reaction (Reaction 7) occur concurrently in the same space, and therefore, the production of hydrogen gas is low and secondary pollution usually occurs.

SUMMARY OF THE INVENTION

To solve the above problems, it is an object of the present invention to provide a method of gasifying organic materials (carbonaceous compounds) such as coal, shredded waste tire or waste oil into gaseous fuel, carbon monoxide and hydrogen, which facilitates the control of temperature in the gasification reactor as well as produces fuel gas of high quality by increasing the concentration of hydrogen.

It is another object of the present invention to provide an apparatus for the gasification method as described above.

To accomplish the above object, the present invention provides a method of gasifying organic materials (carbonaceous compounds) comprising the steps of:

supplying initial fuel gas and oxygen into a gasification reactor to produce water and carbon dioxide;

supplying the organic materials into the reactor and reacting them with the water and carbon dioxide to produce carbon monoxide and hydrogen gas;

discharging the carbon monoxide and hydrogen gas from the reactor;

recycling a part of the carbon monoxide and hydrogen gas discharged from the reactor into the reactor; and reacting the carbon monoxide and hydrogen gas supplied into the reactor with oxygen to produce water and carbon dioxide.

The method of the present invention may comprise further the step of reacting the water and carbon dioxide, that is produced from the recycled carbon monoxide and hydrogen gas, with the organic materials to produce further carbon monoxide and hydrogen gas.

In this method, the oxygen is preferable to be supplied into the gasification reactor as the least amount as is required to maintain the temperature at about 1,300° C. in the reactor, and the carbon monoxide and hydrogen gas is preferable to be supplied into the gasification reactor as the amount as is required to consume the oxygen completely in the reactor.

Specifically, the method of gasifying organic materials of the present invention comprises the steps of:

heating a gasification reactor to a temperature sufficient to gasify the organic materials;

supplying initial fuel gas and oxygen into the reactor to produce water and carbon dioxide with heat;

supplying the organic materials into the reactor and reacting them with the water and carbon dioxide to produce carbon monoxide and hydrogen gas;

discharging the carbon monoxide and hydrogen gas from the reactor;

recycling a part of the carbon monoxide and hydrogen gas discharged from the reactor into the reactor;

reacting the carbon monoxide and hydrogen gas supplied into the reactor with oxygen to produce water and carbon dioxide with heat; and reacting the water and carbon dioxide with the organic materials to produce carbon monoxide and hydrogen gas.

To accomplish another object of the present invention, it is provided an apparatus for gasifying organic materials (carbonaceous compounds) comprising:

a gasification reactor for gasifying the organic materials into carbon monoxide and hydrogen gas;

a means for supplying the organic materials into the reactor;

a means for supplying oxygen into the reactor;

a means for discharging the carbon monoxide and hydrogen gas from the reactor; and a means for recycling a part of the carbon monoxide and hydrogen gas discharged from the reactor into the reactor.

The gasification reactor may have two parts of the same shape and size which are connected each other vertically.

Further, each of the means for supplying oxygen and the means for recycling a part of the carbon monoxide and hydrogen gas may have at least two nozzles arranged on the wall of the reactor at a tangential direction.

In the present invention, by means of recycling the carbon monoxide and hydrogen gas produced from the gasification reaction of the organic materials into the gasification reactor, the recycled gases are oxidized with oxygen to produce $H_2O$ and $CO_2$ and maintain the reactor at high temperature. More specifically, in order to make the condition of high temperature required for gasification reaction and to supply steam for increasing the concentration of hydrogen in the fuel gas (CO and $H_2$) produced from the gasification reaction, a part of the fuel gas (mainly composed of CO and $H_2$) produced from the gasification reaction is recycled into the gasification reactor, and then reacts with appropriate amount of oxygen, which then produces lots of heat, $H_2O$ and $CO_2$. The heat is used for maintaining the gasification reactor at high temperature of about 1,300° C. and $H_2O$ and $CO_2$ gases are converted into $H_2$ and CO by the reduction reaction with the organic materials. That is, in the present invention, the temperature of the gasification reactor elevates sufficiently for the gasification reaction, and then $H_2O$ and $CO_2$ produced from the combustion react with the organic materials to produce fuel gas as well as high temperature required for gasification, all of which facilitate the control of temperature in the gasification reactor and result in the production of fuel gas of high quality by increasing the concentration of hydrogen.

BRIEF DESCRIPTION OF THE DRAWINGS

The above and other objects, features, and advantages of the present invention will be apparent from the following detailed description of the preferred embodiments of the invention in conjunction with the accompanying drawings, in which:

FIGS. 1*a*, 1*b* and 1*c* indicate static floor type, fluid floor type, and flush fluid floor type, respectively;

BEST MODE FOR CARRYING OUT THE INVENTION

Now, preferred embodiments of the present invention will be described with reference to the accompanying drawings.

Figure 1A:
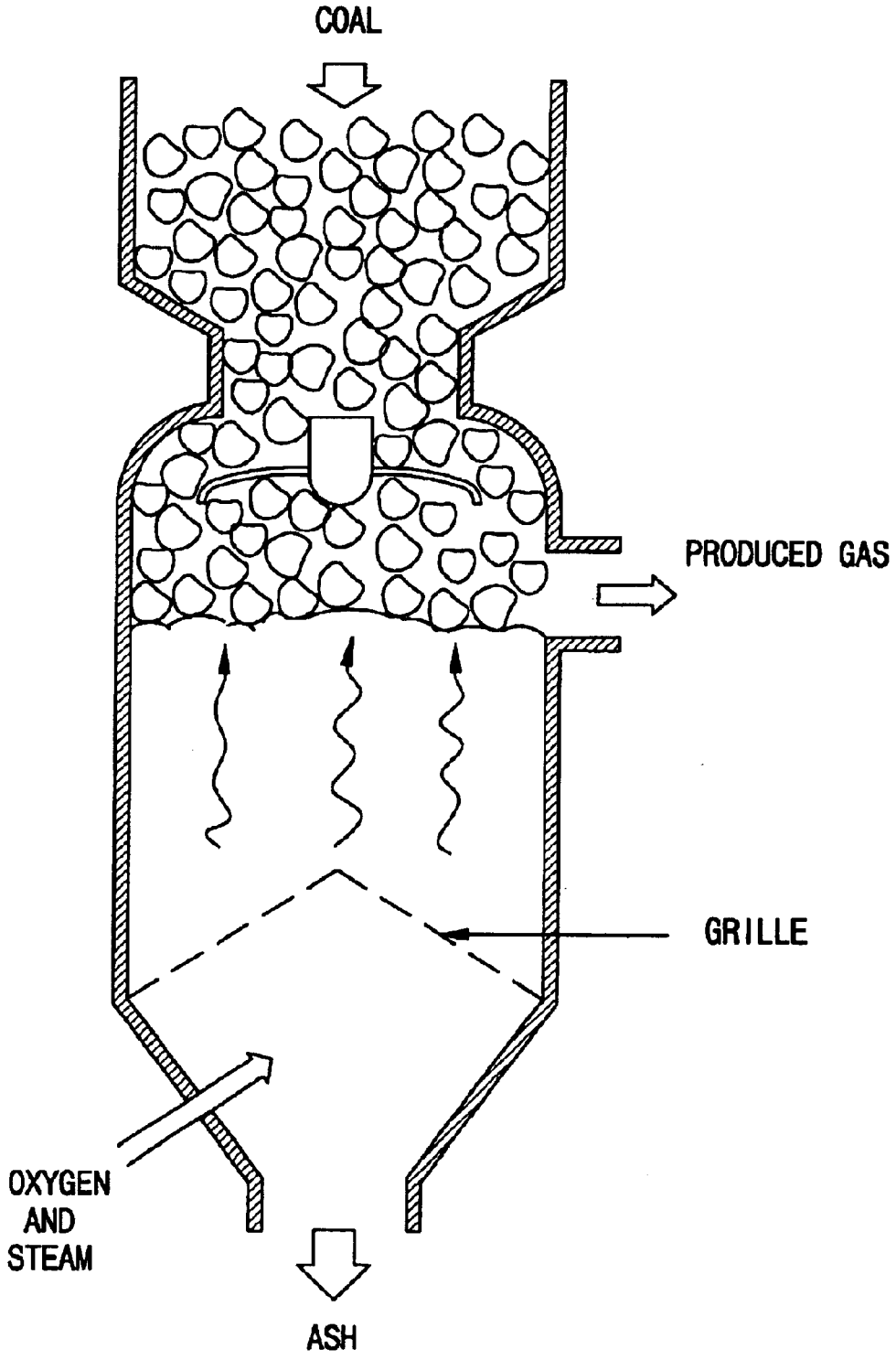
FIGS. 1*a* to 1*c* illustrate schematically the mechanism of conventional system applied to gasification reactor for coal.
Figure 1B:
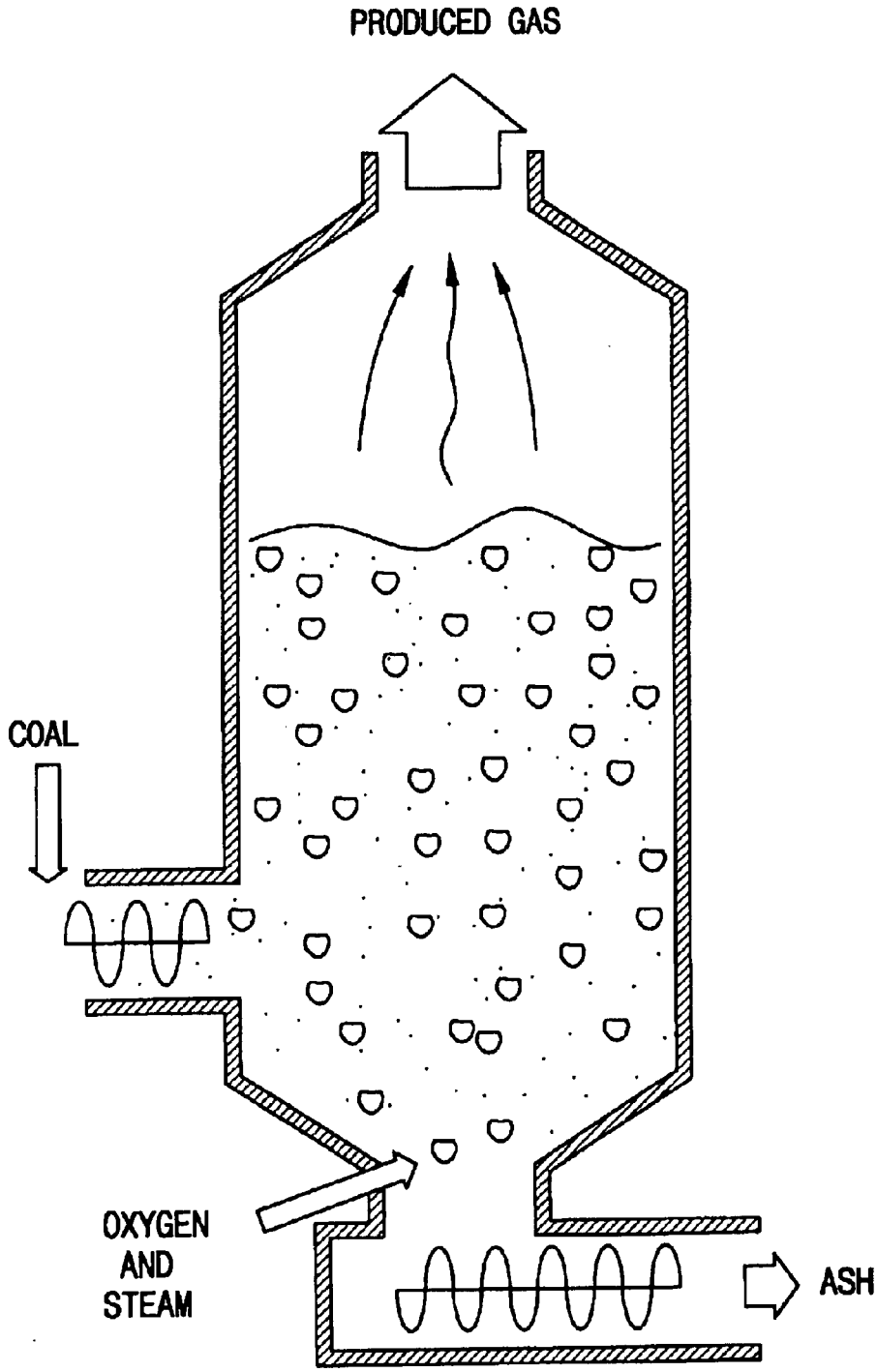
Figure 1C:
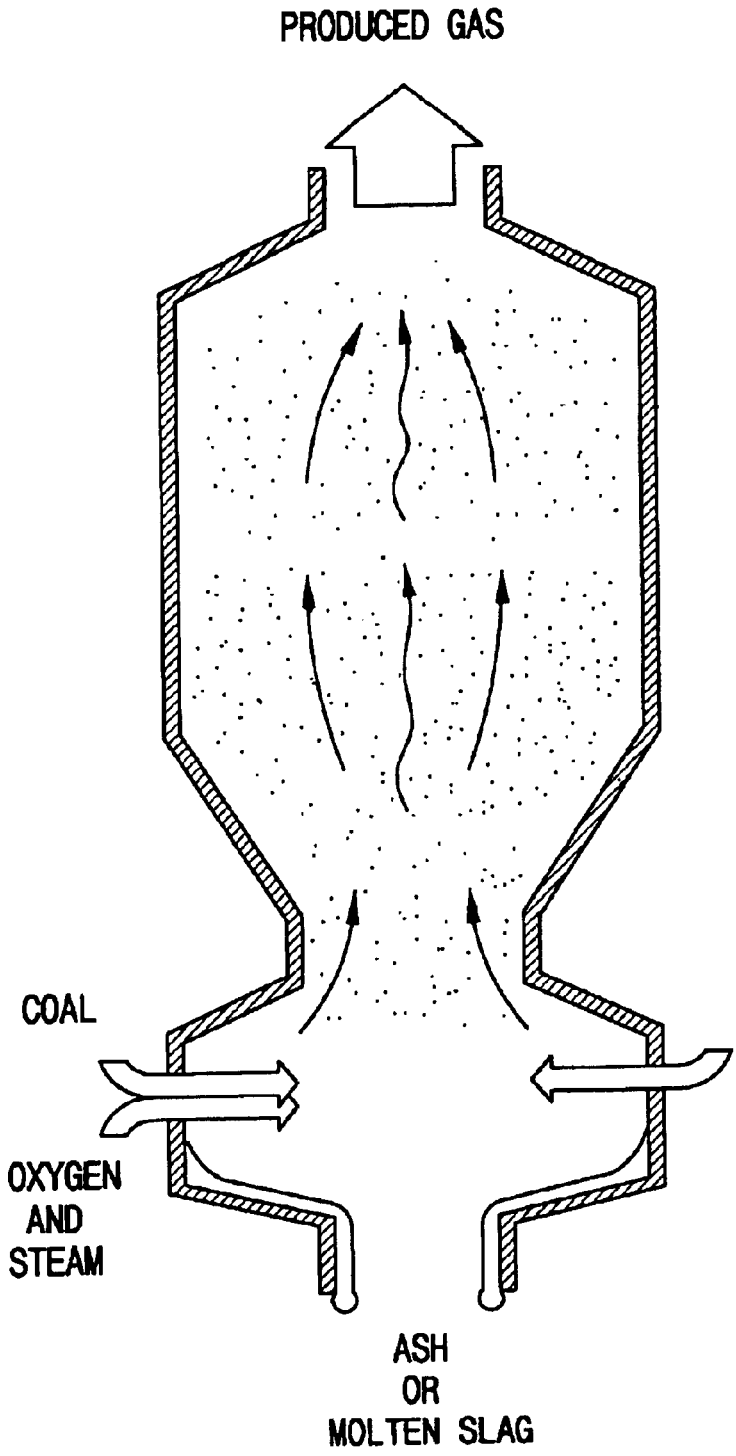
Figure 2:
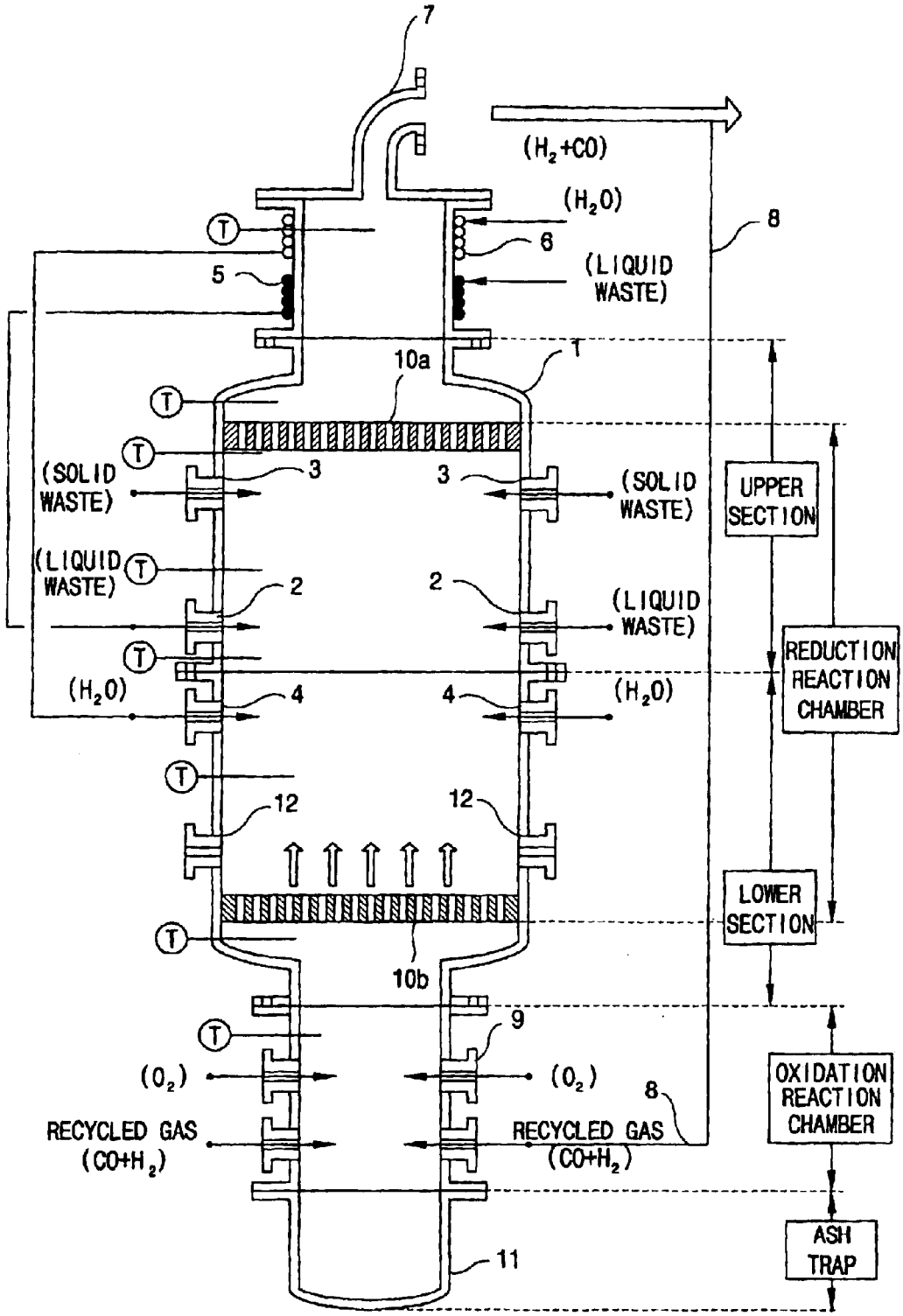
FIG. 2 shows schematically the constitution and mechanism of action of the gasification reactor according to the present invention.

FIG. 2 shows schematically the constitution and mechanism of action of the gasification reactor according to the present invention. As shown herein, a gasification reactor 1 is composed of two parts of the same shape and size which are connected each other vertically. The lower end of the reactor 1 is an oxidation reaction chamber and the middle portion of the reactor 1 is a reduction reaction chamber. In the reduction reaction chamber of the reactor 1, a liquid waste supply nozzle 2 for spouting liquid waste such as waste oil into the reactor 1, a solid waste supply nozzle 3 for supplying solid waste such as coal into the reactor 1 using screw feeder et al., and a steam supplier 4 for spouting steam into the reactor 1 are equipped appropriately according to the supplied waste materials. A liquid waste heater 5 is connected with the liquid waste supply nozzle 2 for heating the liquid waste supplied into the reactor 1, and a water heater 5 is connected with the steam supplier 4 for supplying water into the reactor 1 as steam. An outlet 7 for discharging produced gas from the reactor 1 is provided in the upper end of the reactor 1, and a produced gas recycling tube 8 is installed to recycle the produced gas discharged from the outlet 7 into the reactor 1. Close at the produced gas recycling tube 8, an oxygen supplier 9 is equipped at the lower end of the reactor 1 in the oxidation reaction chamber for supplying oxygen required to react with the produced gas recycled into the reactor 1.

Gasification reactor 1 has two parts of the same shape and size connected each other vertically, which makes the manufacture and maintenance of the reactor 1 easy. In the upper section of the reactor 1, a tungsten grille 10*a* is installed for promoting the reaction of $H_2O$ and $CO_2$ with unreacted organic wastes in the gas to be discharged from the reactor 1. Also in the lower section of the gasification reactor 1, another tungsten grille 10*b* is installed for supplying uniformly $H_2O$ and $CO_2$ produced in the oxidation reaction chamber into the reduction reaction chamber and supporting solid organic materials to be inserted. Between the upper and lower tungsten grilles 10*a* and 10*b*, organic materials react with $CO_2$ and $H_2O$ to produce CO and $H_2$, which is reduction reaction. There is no oxygen present in the reduction reaction chamber, since oxygen supplied through the oxygen supplier 9 is completely consumed in the oxidation reaction chamber. Under the oxidation reaction chamber of the reactor 1, an ash trap 11 is installed for storing remained ash. Further, on the wall of the reactor 1, thermocouples points are installed for measuring the temperature in the reactor 1, and a view port 12 is also installed for viewing the state of the reaction carried out in the reactor 1.

Especially, the produced gas recycling tube 8 for recycling a part of the produced gas is connected with at least two nozzles arranged on the wall of the reactor 1 at a tangential direction. Oxygen supplier 9 is also connected with at least two nozzles arranged on the wall of the reactor 1 at a tangential direction above the nozzles connected with the produced gas recycling tube 8. By supplying oxygen and the produced gas recycled through the nozzles installed at a tangential direction into the reactor 1, the produced gas and oxygen circulate and carry out oxidation reaction to form circular flame of axis symmetry in the reactor 1. Therefore, the produced gas reacts uniformly with oxygen in the reactor 1 to form uniform fluid field of high temperature, which maintain the gasification reactor uniformly at high temperature.

The following is operation of the gasification reactor according to the present invention:

(a) First of all, for initiating the gasification reaction of organic materials (carbonaceous compounds) supplied into the gasification reactor, the reactor at room temperature is heated to a temperature sufficient to combustion by a gas burner using a conventional fuel such as LPG or oil. Typically, the temperature is above 600° C.

(b) When the temperature of the reactor reaches above 600° C., initial fuel gas (generally, LPG gas or stored $CO+H_2$ gas) and oxygen are supplied into the oxidation reaction chamber in the lower end of the reactor through the produced gas recycling tube, and then the temperature of the reactor elevates to about 1300° C. At this time, the reactor becomes filled with combustion products, $CO_2$ and $H_2O$, produced from the reaction of the outside fuel with oxygen.

(c) When the temperature of the reactor is kept at 1300° C., organic materials to be gasified is supplied into the reduction reaction chamber through the organic waste supply nozzles. Then, $CO_2$ and $H_2O$ produced from the reaction of the outside fuel with oxygen are supplied into the lower section of the reactor and reacted with the organic materials to be gasified (reduction reaction indicated as Reactions 3 to 6), which produces fuel gas whose main components are CO and $H_2$.

(d) Fuel gas produced during the gasification reaction is discharged through the upper end of the reactor.

(e) When the fuel gas is discharged from the reactor, a part of the fuel gas is supplied again into the oxidation reaction chamber in the lower end of the reactor through the produced gas recycling tube, and then reacts with oxygen to produce $H_2O$ and $CO_2$ along with heat. At this time, the supply of the outside fuel gas has been cut off. That is, heat source required to maintain the reactor at high temperature is obtained by recycling a part of the produced gas which then reacts with oxygen. At this time, oxygen is supplied as the least amount as required to maintain the reactor at about 1300° C. The combustion products of the recycled fuel gas, $H_2O$ and $CO_2$, react with the organic materials to be gasified (reduction reaction) and produce again fuel gas. The recycled fuel gas, which remains unreacted after the reaction with oxygen, is discharged from the reactor with the rest of the produced fuel gas.

In the gasification reaction of organic materials according to the present invention, when the supplied organic materials contain hydrogen component at a high rate, the amount of steam produced from the combustion is also high, and therefore, the produced fuel gas contains hydrogen at a high rate without supplying outside steam. By controlling the ratio of oxygen and recycled fuel gas, oxygen should be completely consumed in the oxidation reaction chamber, and then, the organic materials should react not with oxygen but with $H_2O$ and $CO_2$, which corresponds to the above Reactions 3 to 6.

In the conventional gasification reaction, oxidation reaction of Reactions 1 and 2, reduction reaction of Reactions 3 to 6, and water gas transition reaction of Reaction 7 are carried out simultaneously at the same space, so the produced fuel gas deteriorates in quality and quantity. According to the present invention, however, oxidation reaction of the fuel gas is carried out at the oxidation reaction chamber in the lower end of the gasification reactor, and reduction reaction of the produced $CO_2$ and $H_2O$ with organic materials is carried out at the reduction reaction chamber in the middle portion of the gasification reactor, separately from the oxidation reaction, which results in production of fuel gas of high quality containing higher concentration of hydrogen.

The following examples are provided for describing the present invention more specifically.

EXAMPLES 1 to 3

Waste oils were gasified at a ratio of 10 kg/hour in the gasification reactor as shown in FIG. 2. The diameter of the reactor is 250 mm and the total length is 2,000 mm including the upper and lower sections. In the lower end of the reactor, gas supply nozzles and oxygen supply nozzles connected with produced gas recycling tube and oxygen supplier, respectively, were installed on the wall at a tangential direction. In the lowest end of the reactor, there was installed a burner for pre-heating the reactor to about 600° C. in the early stage of the reaction. After pre-heating the reactor to the temperature of 600° C., the burner was removed and an ash trap for trapping the ash remained after the gasification reaction was equipped. Further, view ports for viewing the state of the reaction carried out in the reactor and equipments for determining the temperature and pressure in the reactor were installed in the flange on the wall of the reactor.

At the gasification temperature of 1,300° C., the gasification reaction of the supplied waste oils were carried out explosively to discharge $H_2$ and CO gas from the upper end of the reactor.

The compositions of the waste oils used in the examples are shown in Table 1.

TABLE 1

| | Content of the components in 100 kg of waste oil (% by weight)(kmol) | | | | |
|---|---|---|---|---|---|
| Examples | C | H | O | N | S |
| Example 1 | 65 (5.417) | 15 (7.500) | 16 (2.375) | 2 (0.071) | 2 (0.063) |
| Example 2 | 75 (6.250) | 10 (5.000) | 11 (2.219) | 2 (0.071) | 2 (0.063) |
| Example 3 | 85 (7.083) | 5 (2.500) | 6 (2.063) | 2 (0.071) | 2 (0.063) |

Figure 3:
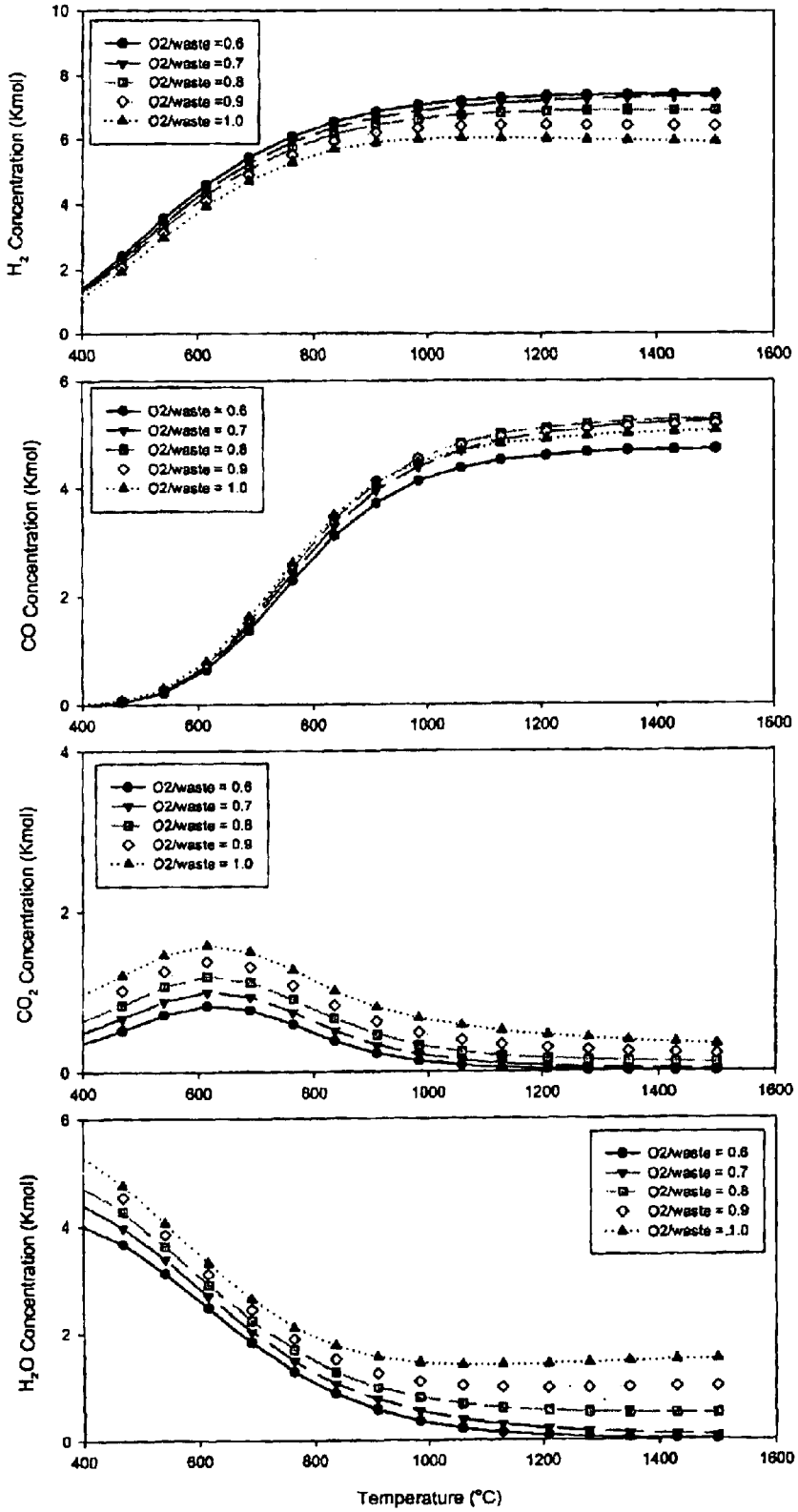
FIG. 3 is a graph illustrating the characteristic of gasification of waste oil having the composition of Example 1 according to the amount of supplied oxygen.
Figure 4:
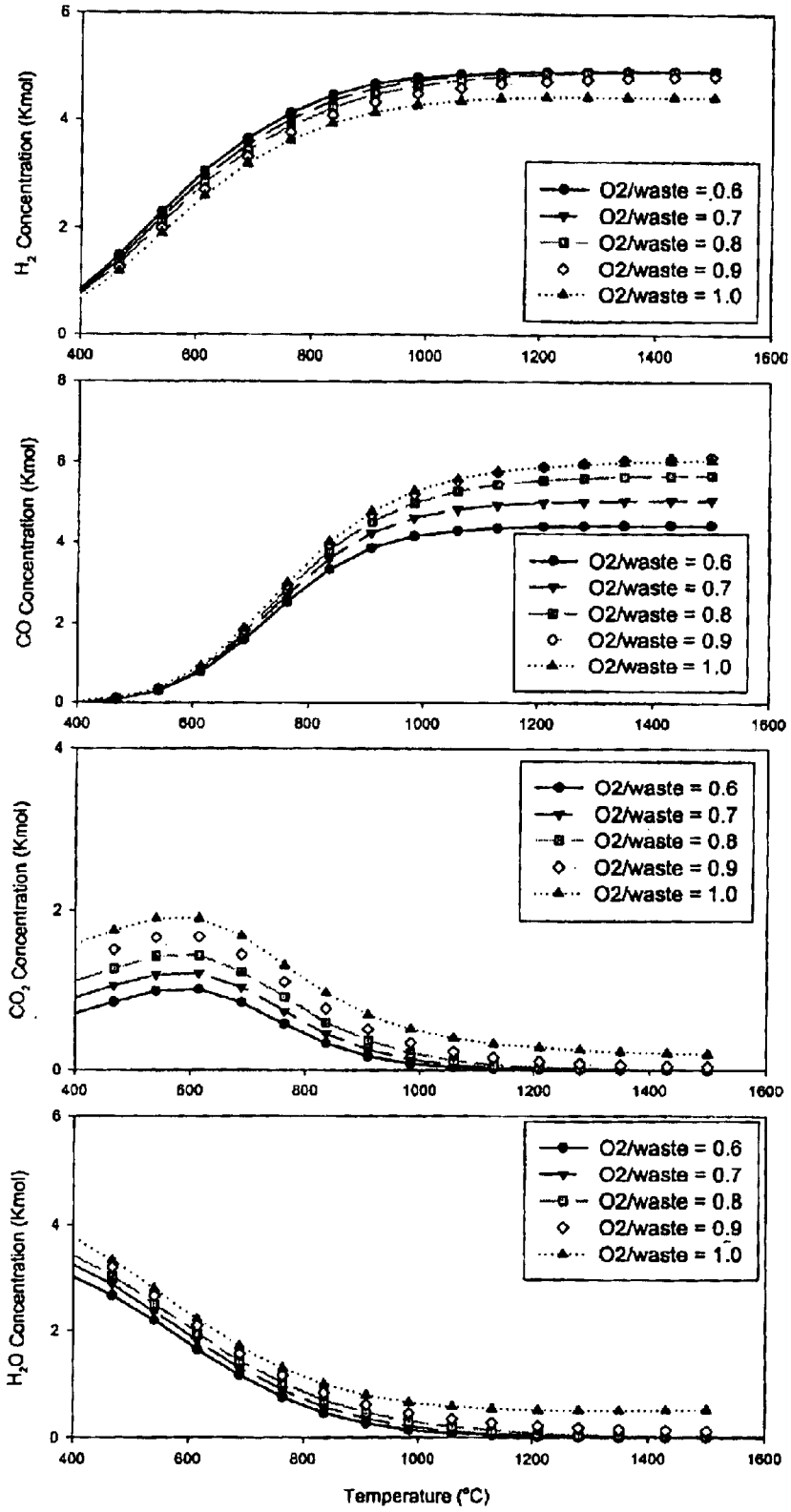
FIG. 4 is a graph illustrating the characteristic of gasification of waste oil having the composition of Example 2 according to the amount of supplied oxygen.
Figure 5:
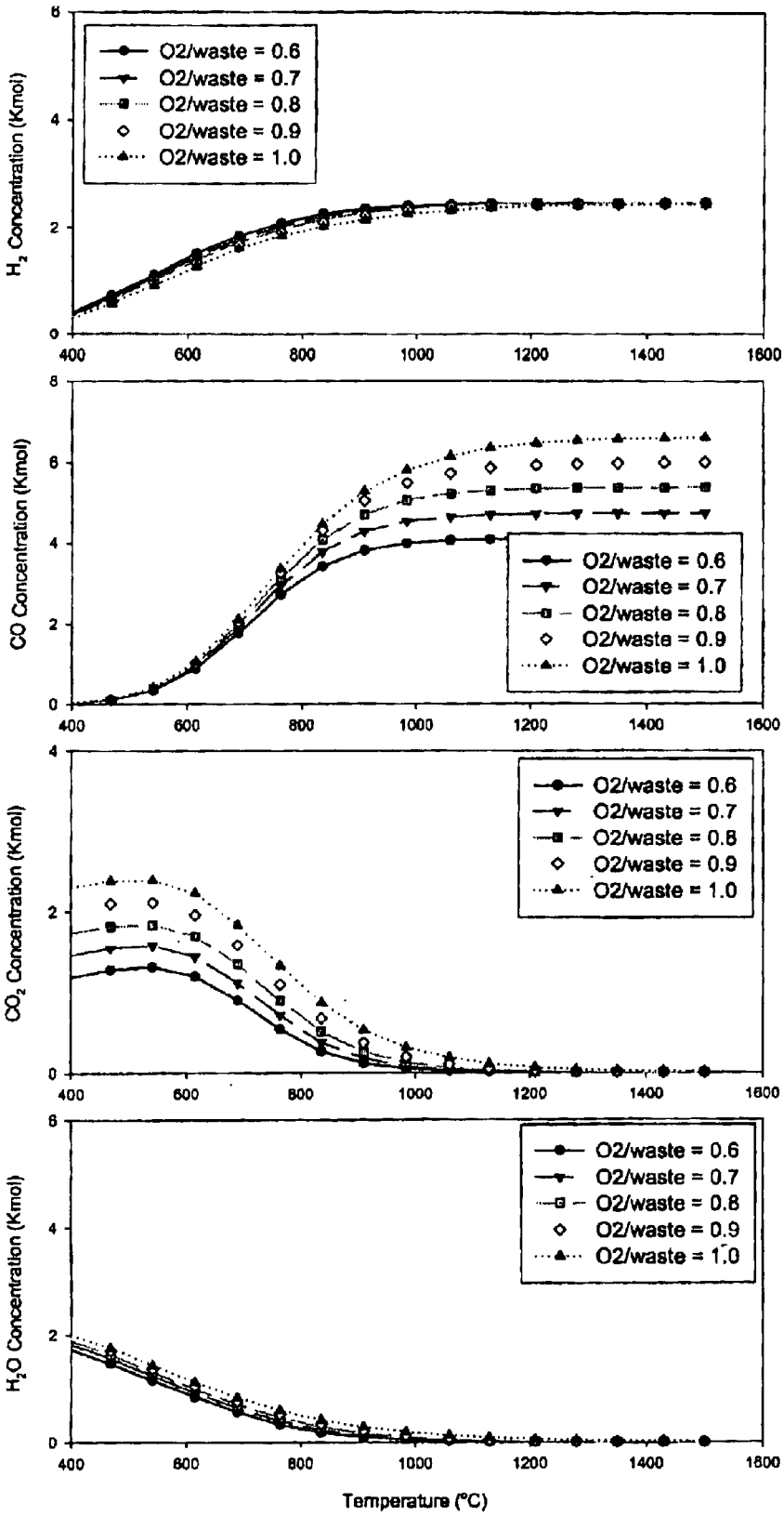
FIG. 5 is a graph illustrating the characteristic of gasification of waste oil having the composition of Example 3 according to the amount of supplied oxygen.
Figure 6:
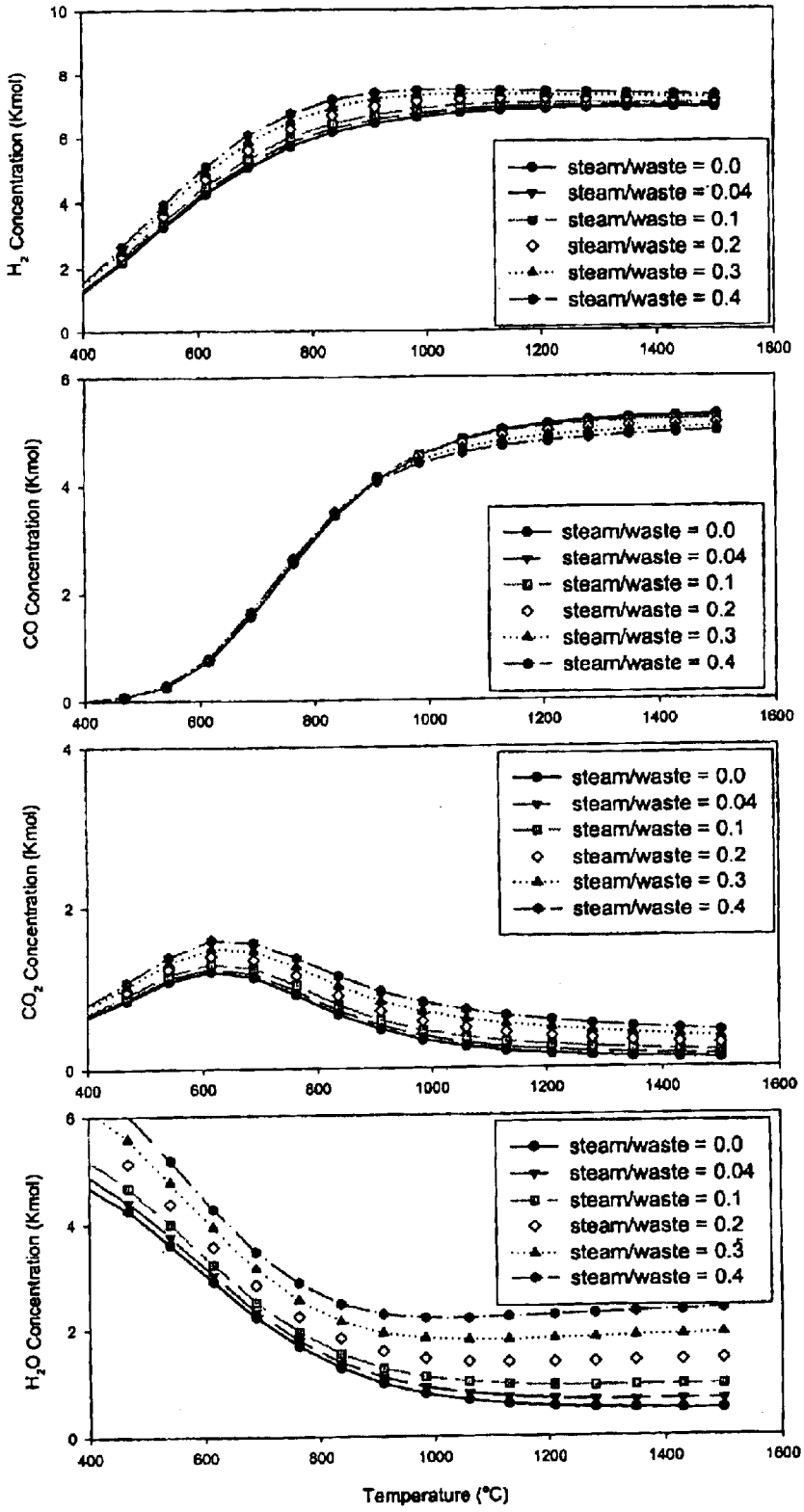
FIG. 6 is a graph illustrating the characteristic of gasification of waste oil having the composition of Example 1 according to the amount of supplied steam when oxygen/waste oil is 0.8.
Figure 7:
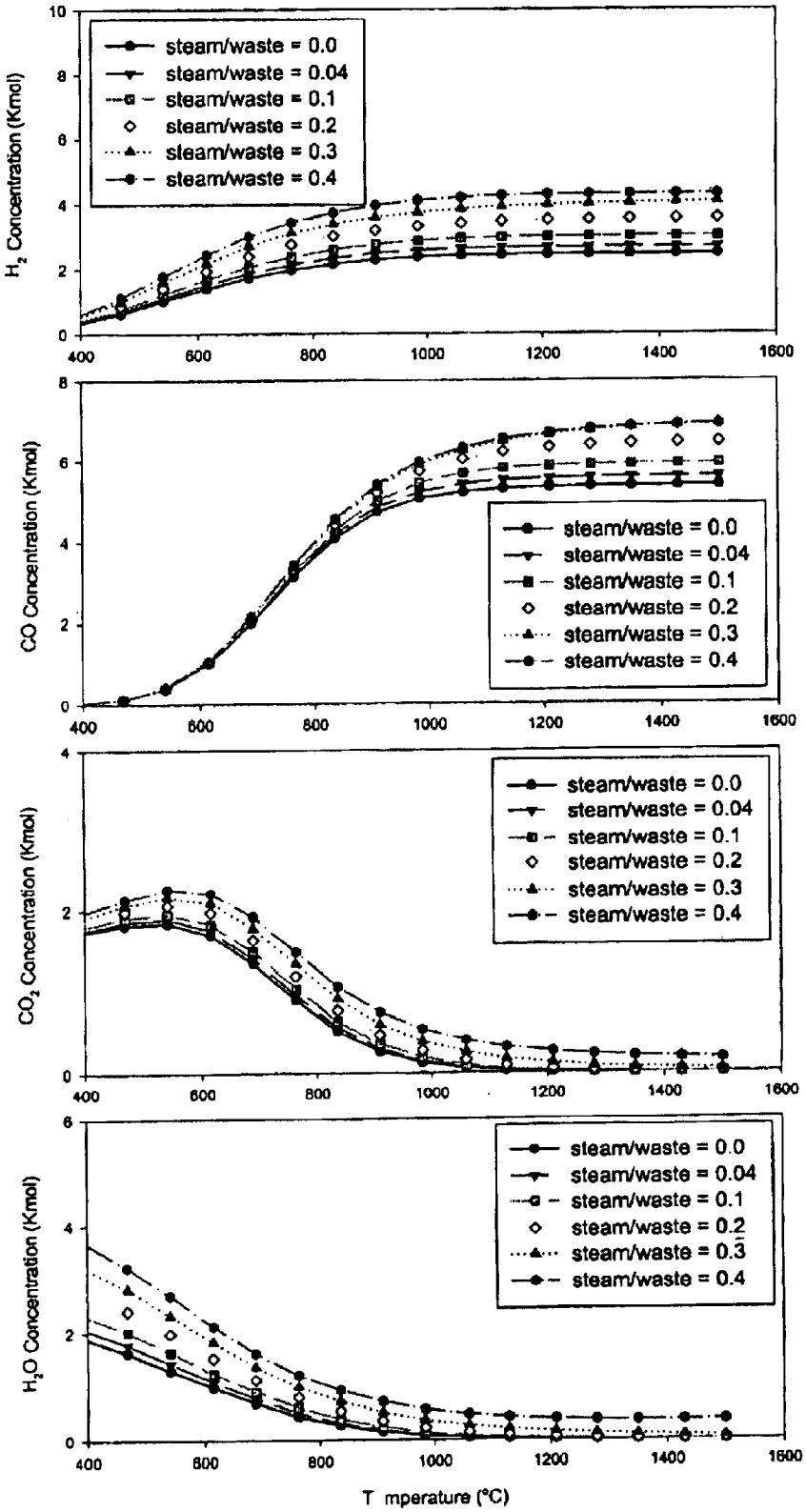
FIG. 7 is a graph illustrating the characteristic of gasification of waste oil having the composition of Example 3 according to the amount of supplied steam when oxygen/waste oil is 0.8.

The gasification reactions of the waste oils having the compositions as shown in Table 1 are shown in FIGS. 3 to 7 in the state of chemical equilibrium. FIGS. 3 to 5 are graphs illustrating the characteristic of gasification of waste oil having the compositions of Examples 1 to 3, respectively, according to the amount of supplied oxygen. FIGS. 6 and 7 are graphs illustrating the characteristics of gasification of waste oil having the compositions of Examples 1 and 3, respectively, according to the amount of supplied steam when oxygen/waste oil is 0.8.

As shown from the results of the Examples, when the ratio by weight of oxygen and waste oil (oxygen/waste oil) is 0.6, the ratio of $H_2$ and CO in the produced fuel gas obtained from the operation of the gasification reactor is determined to be about 2:1. Further, it is also confirmed that the Reaction 4 is the major reaction in the gasification according to the present invention.

In gasifying organic materials (carbonaceous compounds) such as waste oil, shredded waste tire or coal into gaseous fuel, CO and $H_2$ gas, according to the present invention, a part of the fuel gas (mainly composed of CO and $H_2$) produced from the gasification reaction of the organic materials is recycled into the gasification reactor, and then oxidized to produce $H_2O$ and $CO_2$ along with lots of heat. Therefore, the temperature of the gasification reactor elevates sufficiently for gasification and is controlled easily. In the conventional gasification methods, organic materials react directly with oxygen and the reactor is kept at high temperature by such partial oxidation reaction. While in the present invention, instead of the oxidation reaction of organic materials, reduction reaction of organic materials with $H_2O$ and $CO_2$ produced from the oxidation of a part of the produced fuel gas is carried out at high temperature. Therefore, the produced fuel gas has high quality without secondary pollutants generated from oxidation of organic materials and also has high concentration of hydrogen.

While this invention has been described in connection with what is presently considered to be the most practical and preferred embodiments, it is to be understood that the invention is not limited to the disclosed embodiment, but, on the contrary, it is intended to cover various modifications and equivalent arrangements included within the spirit and scope of the appended claims.

What is claimed is:

1. A method of gasifying carbonaceous material in a gasification reactor comprising the steps of:

combusting carbon monoxide and hydrogen gas in an oxidation chamber connected to the bottom of the gasification reactor to produce carbon dioxide and water molecules and exothermic heat;

introducing the carbon dioxide and water molecules and exothermic heat into the gasification reactor so as to maintain the gasification reactor temperature at about 1,300° C.;

reacting carbonaceous material with the carbon dioxide and water molecules in the gasification reactor to produce carbon monoxide and hydrogen gas; and recycling a portion of the produced carbon monoxide and hydrogen gas into the oxidation chamber for continuous operation.

* * * * *